United States Patent [19]

Kataoka

[11] Patent Number: 4,729,520

[45] Date of Patent: Mar. 8, 1988

[54] METHOD AND APPARATUS FOR SUPPLYING SHEET TO WINDING UNIT

[76] Inventor: Hiroshi Kataoka, 3686 Samukawacho, Iyo-Mishima-shi, Ehime-ken, Japan

[21] Appl. No.: 859,232

[22] Filed: May 5, 1986

Related U.S. Application Data

[63] Continuation of Ser. No. 561,973, Dec. 16, 1983, abandoned.

[30] Foreign Application Priority Data

Dec. 22, 1982 [JP] Japan ..... 57-223665

[51] Int. Cl.[4] ..... B65H 16/10; B65H 18/08; B65H 23/18; B65H 35/02

[52] U.S. Cl. ..... 242/56.2; 226/24; 242/56.4; 242/67.5; 242/75.51

[58] Field of Search ..... 242/75.51, 56.2, 56.4, 242/4, 76, 67.5; 226/44, 24, 25

[56] References Cited

U.S. PATENT DOCUMENTS

| | | | |
|---|---|---|---|
| 1,095,661 | 5/1914 | Moulton | 242/56.4 |
| 1,341,651 | 6/1920 | Lammers | 242/75.51 |
| 3,687,389 | 8/1972 | Adams | 242/67.5 |
| 4,004,747 | 1/1977 | Schulze | 242/56.5 |
| 4,025,009 | 5/1977 | Fineo | 242/75.5 X |
| 4,163,180 | 7/1979 | Dowd | 242/75.51 X |
| 4,216,804 | 8/1980 | Alexander, III et al. | 242/75.51 X |
| 4,431,142 | 2/1984 | Kataoka | 242/68.1 |

FOREIGN PATENT DOCUMENTS 996375 12/1978 Japan .

*Primary Examiner*—Stuart S. Levy
*Assistant Examiner*—Lynn M. Sohacki
*Attorney, Agent, or Firm*—Oblon, Fisher, Spivak, McClelland & Maier

[57] ABSTRACT

A plurality of sets of sheet drive rollers including a touch roller for urging a sheet against a core are provided on a running path, along which a sheet is supplied to a core in a shaft drive type winding unit. Two adjacent ones of said sets of sheet drive rollers are coupled to each other by a fine speed adjustment interlock mechanism. The speed change ratio of the fine speed adjustment interlock mechanism is adjusted to remove or reduce the variation in the tension in the sheet between the two rollers and also control the tension to a level suited for the winding.

3 Claims, 9 Drawing Figures

FIG. 7
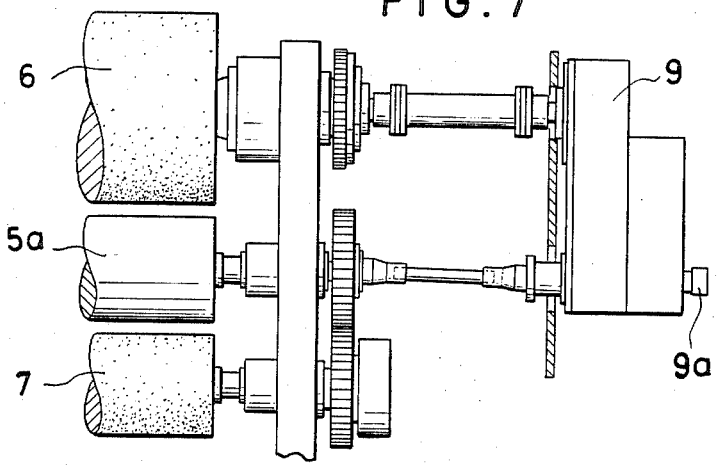
FIG. 8
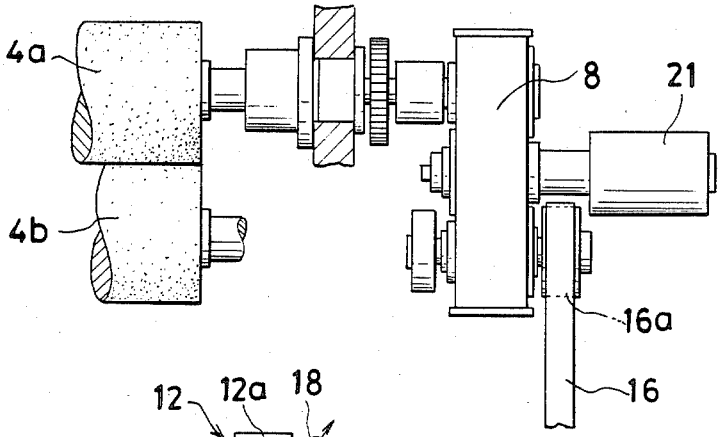
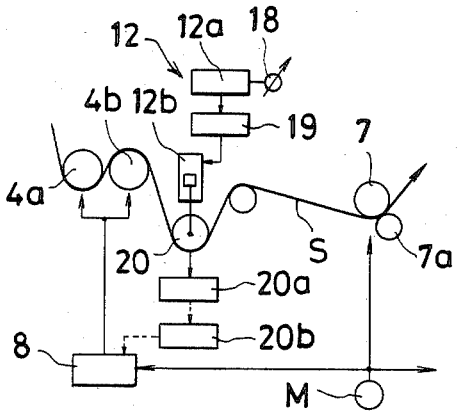
FIG. 9

METHOD AND APPARATUS FOR SUPPLYING SHEET TO WINDING UNIT

This application is a continuation of application Ser. No. 561,973, filed Dec. 16, 1983 now abandoned.

BACKGROUND OF THE INVENTION

This invention relates to a method and apparatus for supplying a sheet to a winding unit.

In the prior art shaft drive type sheet winding machine, the winding torque with which the rewind core shaft is driven for rotation is controlled to hold constant or progressively reduce the winding tension in the sheet during the growth of the wound sheet roll in order to obtain a high quality sheet roll.

The inventor has pointed out that the sole winding tension control as noted above is insufficient for precision winding and that control of the touch pressure with which the sheet is urged by a touch roller against the core is also important, and he has already proposed a specific arrangement to meet this requirement.

The inventor has been continuing studies and investigations concerning the method of supplying a sheet to a winding unit. In the prior art method, the sheet to be wound is withdrawn by the winding force of a core shaft, or the sheet is supplied at a speed, at which it is taken out from its supply roll, to a winding position. The supply roll of sheet, which is stored after it is formed, is usually very heavy, so that its sectional profile is liable to be changed from a true circle to an eccentric circle. When it is rewound, periodic fluctuations in the speed of the sheet being supplied occur, so that it is inevitable that the tension in the sheet fluctuates. A dancer roller is used to cope with the fluctuations in the sheet speed. However, the variation of the sheet tension is inevitable unless the mass of the dancer roller is zero so that the mechanical loss is zero. The variation in the tension in the sheet between the supply roll and the feed-out roller is carried past the feed-out roller to the following section of the sheet running path and constitutes a cause for variations in the sheet winding tension.

The fact described above was discovered by the inventor as a result of his pursuit of a high quality product. Heretofore, it has been believed that the winding tension is determined by its control through control of the core shaft drive torque and control of inter-sheet air layer through control of touch pressure alone, and the interest of engineers has been directed only to this aspect. It has been known that the variation in the tension results from eccentric rotation of the supply roll, but it has been considered that the variation is absorbed by the dancer roller so that it is only necessary to provide perfect control of the winding tension and winding touch pressure. However, if the supplied sheet already is under varying tension or has permanent strain, real improvement of the winding characteristics cannot be expected regardless of how precisely the winding tension and touch pressure are controlled between the core and the touch roller.

Particularly, with recent rapid progress of resin film techniques, there are being produced an increasing number of very thin films on the order of one micron thickness, for instance, and films which are very slippery or readily capable of elongation so that they are very inconvenient to handle. Also, there is a trend toward increasing the scale and operation speed of film production equipment, and wide supply rolls of 6 to 8 m have to be processed. Accordingly, a technique for taking out such a delicate and wide sheet from a supply roll having eccentricity and stably supplying it to a winding position has become very important.

The inventor first sought means for preventing the deterioration of the winding characteristics due to variation in the tension in the running sheet caused by the eccentric rotation of the supply roller. As a result, he contemplated once reducing the tension in the running sheet to zero immediately before the running sheet is wound on a core. This process was patented under Japanese Pat. No. 966,375.

Although this method is able to most reliably solve the problem of tension variation, it was subsequently found to be unsuitable for the control of the winding tension. More specifically, where a sheet perfectly free from tension is supplied between a touch roller and a core or a sheet roll growing thereon, in which case the friction between the sheet and the touch roller is zero, the necessary winding tension cannot be obtained unless the contact pressure between the touch roller and the sheet roll growing on the core is sufficiently high or a separate pinch roller cooperating with the touch roller is provided. A second drawback is that it is difficult to cause a sheet under zero tension to proceed in a correct posture to the winding position. Thirdly, it is undesirable to cause a sudden change in the sheet tension at the winding position. It is concluded that the sheet fed between the core of a shaft drive type winding unit and the touch roller must not only be free from tension variations but must also be under a tension adjusted to a level suited for the winding. The present invention is predicated on this conclusion.

SUMMARY OF THE INVENTION

The primary object of the invention is to provide a method of supplying a sheet to a winding unit which takes into consideration the fact that not only the conventional winding tension control and dancer roller contact pressure control but also precision control of the tension in the sheet being supplied is important for the winding of the sheet in the shaft drive type sheet winding unit.

Another object of the invention is to provide a method of supplying a sheet to a winding unit in which the tension in the sheet being supplied to a winding position is adjusted to a level suited for the winding in a sheet running path independently of the winding force provided by the core shaft.

A further object of the invention is to provide an apparatus for supplying a sheet to a winding unit in which the sheet running path is divided into a plurality of sections by a plurality of sets of sheet drive rollers and a driven touch roller offering a large coefficient of friction. The tension variation is first removed in one of said sections, and the tension is adjusted to a level suited for the winding in a subsequent section including the touch roller.

A still further object of the invention is to provide an apparatus for supplying a sheet to a winding unit in which a predetermined sheet tension is set for some or all of the sections and is held through a feedback control.

A still further object of the invention is to provide an apparatus for supplying a sheet to a winding unit which includes a slitter and in which the tension variation is removed or reduced. The sheet is expanded in one section, and a predetermined tension is given and the sheet is slitted in one of the subsequent sections.

To attain the above and further objects of the invention, there is provided a method of supplying a sheet to a winding unit in which a sheet drive roller provided on a sheet running path and a core of a shaft drive type winding unit and a touch roller for urging the sheet against the core are coupled to each other with a fine speed adjustment interlock mechanism. The tension in the sheet between the two rollers is adjusted to a level suited for the winding by adjusting the speed change ratio of the fine speed adjustment interlock mechanism.

According to the invention, the sheet running path itself can adjust the sheet tension independently of the winding force provided by the core shaft, so that the sheet is under an adjusted tension suited to the winding when it is fed to the winding position.

An apparatus for supplying a sheet to a winding unit, which is provided to attain the above and further objects of the invention, comprises a sheet running path leading to a core of a shaft drive type winding unit and including:

- a touch roller rotated while urging the sheet against the core with its outer periphery;
- a plurality of sets of sheet drive rollers provided one after another before the touch roller in the direction of progress of the sheet;
- a first fine speed adjustment interlock mechanism coupling two adjacent ones of the plurality of sheet drive rollers to each other; and
- a second fine speed adjustment interlock mechanism coupling the touch roller and one of the sheet drive rollers nearest the touch roller;
- the variation in the tension in the sheet in the sheet running path being removed or reduced in a section thereof between the two rollers coupled to each other by the first fine speed adjustment interlock mechanism, the sheet tension being adjusted to a level suited for the winding in a section of the sheet running path between the two rollers coupled to each other by the second fine speed adjustment interlock mechanism.

The apparatus for supplying a sheet to a winding unit may further comprise a tension setter/controller for setting the tension in the sheet between the sheet running path section between the rollers coupled to each other by the first and/or second fine speed adjustment interlock mechanisms and effecting feedback control of the fine speed adjustment interlock mechanism for the section by detecting the sheet tension.

The apparatus for supplying a sheet to a winding unit may further comprise an expander roller provided between the two sheet drive rollers and a sheet slitter provided between the touch roller and one of the sheet drive rollers nearest thereto, the variation of the tension in sheet tension variation being removed or reduced and the sheet being expanded in the sheet running path section between the two rollers coupled to each other by the first fine speed adjustment interlock mechanism, the sheet tension beng adjusted to a level suited to the winding and the sheet being expanded in the sheet running path section between the two rollers coupled together by the second fine speed adjustment interlock mechanism.

The sheet supply apparatus according to the invention not only includes a portion for carrying out the sheet supply method according to the invention but can also serve as a practical sheet supply apparatus with sheet drive rollers for removing or reducing the sheet tension variation. The sheet drive rollers either serve to sandwich the sheet, or the sheet is passed round them such that the former does not slip over the latter. They function to restrict the section where there is periodic tension variation so that no tension variation is carried forward to the following section. With sheet drive rollers provided in two successive sections and coupled to each other by a fine speed adjustment interlock mechanism, it is possible to obtain adjustment of the sheet tension in the section between the two rollers independetly of the other sections of the sheet running path as well as to realize removal or reduction of the tension variation. Further, with the expander provided in this section, the width of the sheet can be increased to a constant width. Further, the sheet can be slitted to a constant width by the slitter.

Further, with the provision of the tension setter/controller, the winding tension control, which has heretofore resorted solely to the winding torque, can be effected on the sheet running path by the feedback control system. It may be said that the precision winding technology which has been in progress has been brought to perfection by the present invention.

The above and further objects, features, and advantages of the invention will become more apparent from the following description when the same is read with reference to the accompanying drawings.

BRIEF DESCRIPTION OF THE DRAWINGS

FIGS. 6 to 8 are views showing respective examples of fine speed adjustment interlock mechanism.

FIG. 9 is a schematic representation of a different embodiment of the invention with a tension setter/controller.

DETAILED DESCRIPTION OF THE INVENTION

Figure 1:
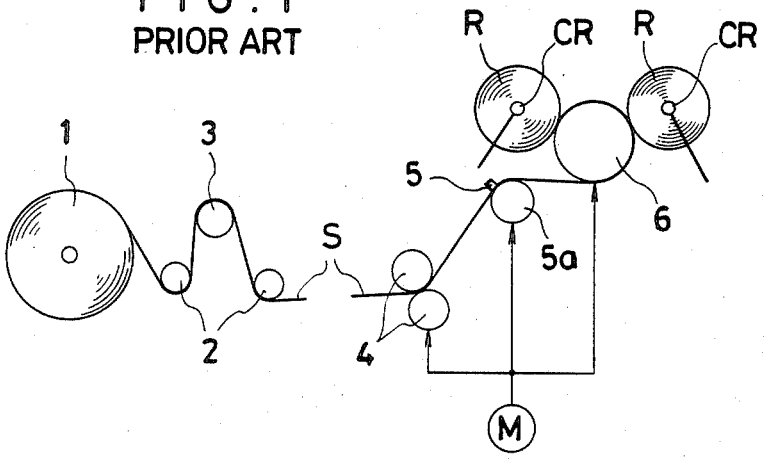
FIG. 1 PRIOR ART
FIG. 1 is a schematic view showing a prior art apparatus for supplying a sheet to a winding unit.

FIG. 1 shows the most up-to-date apparatus for rewinding a sheet on a core. As a sheet S is taken out from a supply roll 1 by a feed-out rollers 4, it runs along a major portion of a sheet supply path past guide rollers 2 and a dancer roller 3. The sheet S having reached the feed-out rollers 4 is slitted as it passes between a slitter 5 rotating at a constant speed in an interlocked relation to the feed-out rollers 4 and a bearing roller 5*a*. The sheet S is then led past a touch roller 6 to be wound on the outer periphery of sheet rolls R being wound on left and right cores CR. In this example, the touch roller 6 is a drive roller having a large size held at a stationary position. An ordinary touch roller, however, is biased against the roll being wound on a core and rotated with the rotation of the same. The periodic variations in the rotational speed due to the eccentricity of the supply roller 1, as noted earlier, will cause periodic variations in the tension in the sheet S proceeding between the supply roll 1 and feed-out rollers 4. The variations in the tension cannot be removed by the action of the dancer rollers 3. The sheet S running past the feed-out roller 4 is under strong tension (i.e., internal stress) for one half of the periphery of the supply roll 1 and under weak tension for the other half. The portion of the sheet running path after the feed-out rollers 4 in the direction of the progress of the sheet does not include any section having a length sufficient for the cancellation of the strong and weak tensions in the respective positions of the sheet. In this example, the feed-out rollers 4, bearing roller 5*a*, and touch roller 6 are rotated at an equal rotational speed by a common drive source. Therefore, the variations in the tension under the sheet remain until the sheet is brought to a winding position. This drawback applies in case where the touch roller 6 is driven by the rotation of the cores CR. Further, with the apparatus of FIG. 1, not only the tension in the sheet S supplied to the path between the touch roller 6 and cores CR (i.e., sheet rolls R being wound) undergoes periodic variation, but the tension for taking out the sheet S from the supply roll is substantially maintained without change and is not suited for the sheet to be wound.

Figure 2:
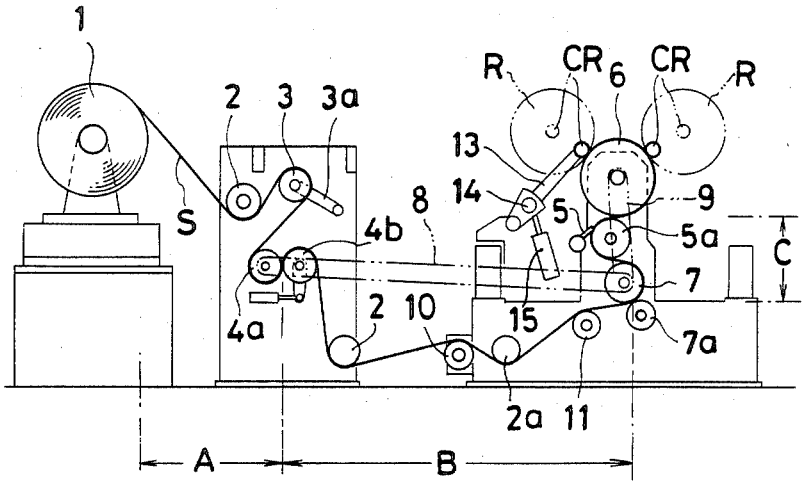
FIG. 2 is a schematic elevational view showing an embodiment of the sheet supply apparatus according to the invention.
Figure 3:
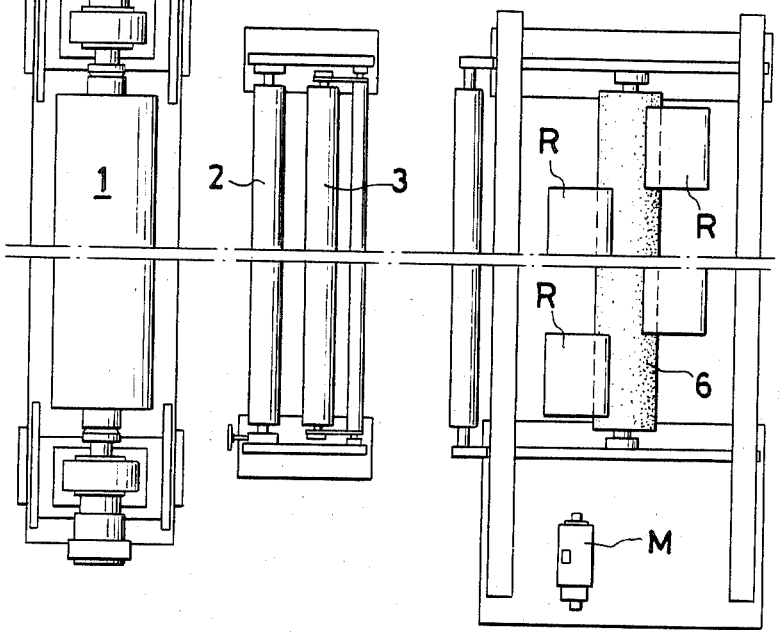
FIG. 3 is an enlarged plan view showing part of the apparatus of FIG. 2.
Figure 4:
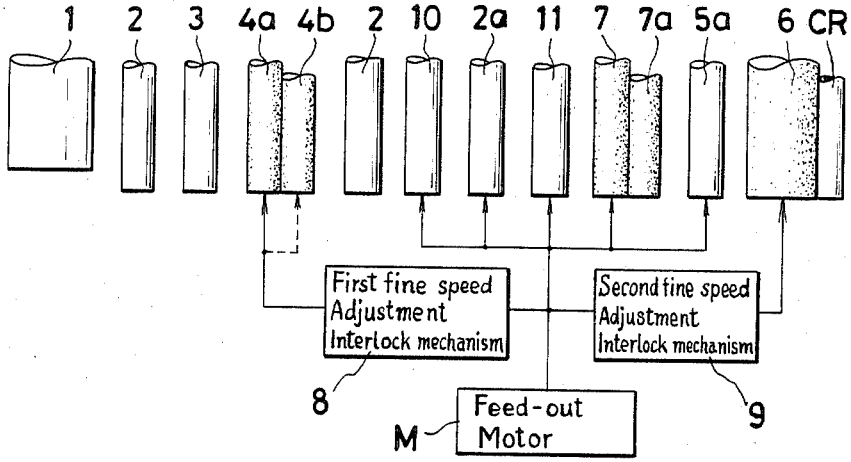
FIG. 4 is a schematic representation of a drive mechanism in the apparatus of FIG. 2.

FIGS. 2 and 3 show an embodiment of the apparatus according to the invention, and FIG. 4 is a block diagram illustrating a drive mechanism of the same.

This apparatus for rewinding a sheet on a core comprises, along a running path of sheet S toward cores of a shaft-driven winding unit, a touch roller 6 which is rotated while urging the sheet S against the sheet rolls being wound on the cores CR by its outer periphery, and a plurality of, in the instant embodiment two, drive roller sets, i.e., first drive rollers 4*a* and 4*b* and second drive rollers 7 and 7*a*, provided before the touch roller 6 in the direction of progress of the sheet. The apparatus further comprises a first fine speed adjustment interlock mechanism 8 coupling the set of first drive rollers 4*a* and 4*b* and the set of second drive rollers 7 and 7*a* (actually coupling the rollers 4*a* and 7) and a second fine speed adjustment interlock mechanism 9 coupling the touch roller 6 and the set of second drive rollers 7 and 7*a* (actually the drive roller 7). The variations in the tension in the running sheet S are removed in a portion of the running path between the rollers 4*a* and 7 coupled together by the first fine speed adjustment interlock mechanism 8 (i.e., section B), and the tension is adjusted to a level suited to the winding in a portion of the running path between the rollers 7 and 6 coupled together by the second fine speed adjustment interlock mechanism 9 (i.e., section C). The removal of the tension variations and adjustment of the tension to the level suited to the winding are effected by adjusting the speed change ratios of the first and second fine speed adjustment interlock mechanisms 8 and 9.

The operation of the apparatus will not be described prior to describing the construction thereof in detail.

As the sheet S is taken out from the supply roll 1 by the set of first drive rollers 4*a* and 4*b*, it proceeds past the guide roller 2 to the dancer roller 3. A biased arm 3*a* causes rocking of the dancer roller 3 according to the rotational speed of the supply roll 1, thereby preventing sagging of and overtension in the sheet S and causing the sheet S to proceed substantially at a uniform speed between the first drive rollers 4*a* and 4*b* disposed in the neighborhood of the dancer roller 3.

Figure 5:
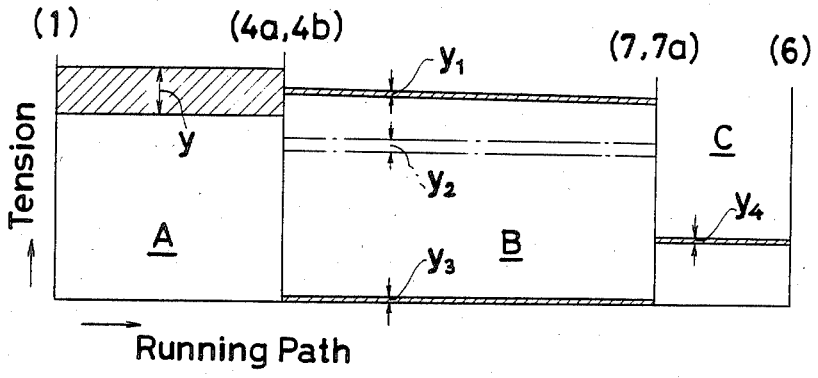
FIG. 5 is a view illustrating tension variation in a sheet running path of the same apparatus.

The first drive rollers 4*a* and 4*b* which are disposed near the supply roll 1 serve the role of the feed-out roller 4 in the prior art apparatus of FIG. 1, which is pulling the sheet from far away from the supply roll 1, i.e., a position near the winding position. The tension in the sheet in the running path between the first set of drive rollers 4i a and 4*b* and supply roll 1 varies periodically with the rotation of the supply roll, the periphery of which is not a true circle. The magnitude of variation is generally quite large as indicated at y in a section A as shown in FIG. 5, although it depends on the performance of the dancer roller 3. The section A is defined between the supply roll 1 and first drive rollers 4*a* and 4*b*.

The tension in the sheet in the section A is roughly determined by the braking action offered from the side of the supply roll 1 against the pulling force of the set of first drive rollers 4*a* and 4*b*, and it is increased and reduced periodically due to the eccentricity of the supply roll 1, the magnitude of periodic variation of the tension being the magnitude y. In the case of FIG. 1, the tension in the sheet in a long section between the supply roll 1 and the feed-out roller 4 is varied in a timed relation to the rotation of the supply roll. In the prior art, the variations in the tension are removed by the feed-out roller 4, but the tension in a small portion of the sheet proceeding past the feed-out roller 4 (i.e., elastic elongation thereof) varies periodically to cause periodic variation of the tension of the sheet in the next section up to the touch roller 6.

The tension in the small portion of the sheet S proceeding past the set of first drive rollers 4*a* and 4*b* at the end of the section A and entering the section B up to the set of second drive rollers 7 and 7*a* according to the invention will now be described. When the sheet enters the section B, it no longer receives the direct influence of the eccentric rotation of the supply roll 1. In this sense, the sheet is isolated from the section A. However, the small portion of the sheet S brings the tension or internal stress (i.e., elastic elongation) at the end of the section A as such into the section B.

The first fine speed adjustment interlock mechanism 8, which couples the set of first drive rollers 4*a* and 4*b* and set of second drive rollers 7 and 7*a* in the section B to each other and provides a speed difference, can adjust the elastic elongation brought in by the small portion of the sheet S—that is, it can add to or reduce the elongation. The elongation brought into the section B by the small portion of the sheet varies periodically. However, as soon as the small portion of the sheet enters the section B, the elastic elongation brought in by it is uniformly distributed over the entire section B. Thus, when the length of the section B of the running path of the sheet is equal to the circumference of the supply roll 1, which constitutes the cycle of variation, or an integral multiple thereof, the elastic elongations of all the small portions of the sheet in the section B are off-set to zero in such a form that a small portion for which the net elastic elongation is positive is followed by a small portion for which the net elastic elongation is negative. That is, the variation of tension is substantially reduced to zero as shown at $y_1$ in FIG. 5. However, the length of the section B can not always be made equal to the circumference of the supply roll 1 because the circumference of the supply roll 1 is continuously decreasing. Accordingly, the variation in tension is not always made zero, but remains to an extent corresponding to the difference between the length of the section and the circumference of the supply roll or an integral multiple thereof. However, only the aforementioned extent of the tension variation remains—that is, the overall tension variation is considerably reduced, and the remaining tension variation is of an order as indicated at $y_2$ in FIG. 5, for instance. The length of the section B of the running path of the sheet may be made always equal to the circumference of the supply roll by using a variable guide roller.

If the tension in the sheet S running in the section B can be made zero by appropriately adjusting the speed difference between the set of first drive rollers 4a and 4b and set of second drive rollers 7 and 7a, the tension variation can be completely removed. However, if the tension in the running sheet is completely moved, sagging or wrinkles of the sheet are apt to occur. For this reason, the tension is reduced to as near zero as possible in such a range that smooth progress of the sheet can be ensured.

A state in which the tension and the variation thereof are both reduced to very low levels is shown at $y_3$ in FIG. 5. The effect of prevention of tension variation can also be obtained by feeding the sheet S in the state noted above past the feed-out rollers 4 and the slitter 5 to the touch roller 6 in the prior art apparatus of FIG. 1.

In the rewinding apparatus, however, it is not only necessary to remove or reduce the variation of tension in the running path of the sheet, but also a mechanism which permits free adjustment of the tension in the sheet immediately before the winding must be provided. In the prior art, the feed-out rollers 4 and the touch roller 6 are rotated at an equal speed and in an interlocked relation as shown FIG. 1. According to the invention, the set of second drive rollers 7 and 7a and the touch roller 6 are interlocked to one another by the second fine speed adjustment interlock mechanism 9. More specifically, the variation of tension is reduced in the section B between the sets of first and second drive rollers, and the tension in the sheet S is adjusted to a level suited to the winding in the next section C, as noted earlier. More specifically, the speed change rate of the second fine speed adjustment interlock mechanism 9 is controlled to control the tension in the section between the set of second drive rollers 7 and 7a and the touch roller 6 such that when the sheet S under the adjusted tension proceeds between the touch roller 6 and the sheet rolls R being wound on the cores CR, the sheet S can be wound by the winding force of the cores CR in the correct posture and without slip over the outer periphery of the touch roller 6. The suitable adjusted tension is indicated at $y_4$ in FIG. 5, for instance.

Thus, a first expander roller 10 and a second expander roller 11 are provided in the section B, and the slitter 5 is provided in the section C. Accordingly, the sheet S is sufficiently expanded in a stable state in the section B, and the sheet S under stable tension is slitted by the slitter 5 in the section C.

The width of the sheet S varies according to the variations of the tension in it, particularly when the sheet S is a resin film. Heretofore, a sheet having varying width has been slitted by slitter blades at a fixed interval, so that the variation in the width of the wound sheet rolls occur. According to the invention, this problem can be solved, and it is possible to obtain a sheet roll having an accurate predetermined width.

Now, the details of the apparatus according to the invention and means for permitting the fine speed adjustment interlock mechanisms 8 and 9 to produce a speed difference between the opposite end rollers in the sections B and C for reducing the tension variations and obtaining a predetermined tension will be described.

The embodiment of FIGS. 2 and 3 uses a feed-out motor M as a drive source. Winding arms 13 are pivoted to the opposite ends of the core CR and urge it against the touch roller 6. They are pivotally displaced toward the upright position with the growth of the sheet roll R. A magnetic powder clutch 14 connected to each of the winding arms 13 receives output of a winding motor (not shown), and its output is transmitted to the core CR via a transmission mechanism along the associated winding arm 13. The winding tension is winding torque. That is, the winding tension is controlled by the magnetic powder clutch 14 according to a predetermined pattern. Further, the contact pressure between the touch roller 6 and the core CR (or sheet roll growing thereon) is controlled according to the progress of winding by an oil hydraulic cylinder 15 which functions to raise the winding arms 13.

The feed-out motor M, as shown in FIG. 4, drives the second drive rollers 7 and 7a, bearing roller 5a with groove to receiving the slitter 5, first and second expander rollers 10 and 11 and a guide roller 2a. The second set of drive rollers 7 and 7a and first set of drive rollers 4a and 4b are interlocked to each other by the first fine speed adjustment interlock mechanism 8, and the second set of drive rollers 7 and 7a and touch roller 6 are interlocked to each other by the second fine speed adjustment interlock mechanism 9.

Figure 6:
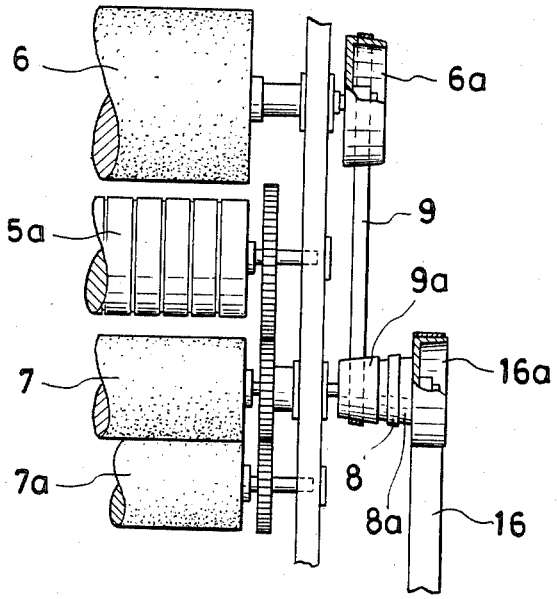

FIG. 6 shows an example of the fine speed adjustment interlock mechanism which has the most important role in the invention. It is the second fine speed adjustment interlock mechanism 9 coupling the second set of drive rollers 7 and 7a and touch roller 6 to each other. The feed-out motor M, as shown in FIG. 4, structurally directly drives the second drive roller 7, to which the slitter receiving roller 5a, the first and second expander rollers 10 and 11 and a guide roller 2a are interlocked. The feed-out motor M is further interlocked to the first drive rollers 4a and to the 4b and touch roller 6 via the first and second fine speed adjustment interlock mechanisms 8 and 9. In the arrangement shown in FIG. 6, the second drive roller 7 is driven from the feed-out motor M via a belt 16, and its shaft has cone pulleys 8a and 9a, around which belts of the fine speed adjustment interlock mechanisms 8 and 9 are passed. In FIG. 6, only a cone pulley 6a for the touch roller 6 is shown, and the cone pulley for the first drive roller 4a is not shown.

The shafts of the fine speed adjustment interlock mechanisms 8 and 9 are rotated at rotational speeds different from each other by several percent. For the driving, it is possible to use suitable well-known techniques, for instance a system where cone pulleys are coupled together by a lateral belt, other mechanical systems such as differential gears, and electric systems.

FIG. 7 shows a different example of the fine speed adjustment interlock mechanism 9, which is a commercially available product using differential gears. The speed change ratio is adjusted by a knob 9a. In this example, the second drive roller 7 and the bearing roller 5a with the slitter 5 are coupled together by gear means for rotation at an equal speed, and the bearing roller 5a and the touch roller 6 are interlocked to each other by the fine speed adjustment interlock mechanism 9.

A method of controlling the tension in the sheet S in the sections B and C in FIG. 5 with the fine speed adjustment interlock mechanisms 8 and 9 will now be described. To reduce a 5% elastic elongation (i.e., tension), which is given to the sheet S in the section A, to zero, the rotation of the second drive rollers 7 and *7a* may be set slower by 5% than the rotation of the first drive rollers 4a and 4b at the inlet of the section B (under the assumption that the elongation of material is proportional to the tension therein). If the variation of the tension in the sheet in the section S is 5 to 10%, it can be completely removed by setting the speed difference to 10%. Generally, the tension in the section is varied in proportion to the speed difference between drive rollers.

With the length of the running path of the sheet S in the section B set equal to the circumference of the supply roll 1, only the variation in the tension can be removed regardless of the speed difference between the first and second drive rollers—i.e., the tension.

With the second drive rollers 7, *7a* rotated at a speed equal to the speed of the first drive rollers 4a, 4b, the tension in the sheet S in the section B is the average tension in the sheet S in the section A. With the second drive rollers 7, *7a* rotated at a speed higher or lower by 5% than the speed of the first drive rollers 4a, 4b, the tension in the sheet S in the section B will be higher or lower by 5% than the average tension in the sheet S in the section A.

In embodiment shown in FIG. 2, the section B is a place in which the sheet S is expanded by the first and second expander rollers 10 and 11 as well as a place for removing the variation in the tension. Accordingly, it is desired to maintain an appropriate tension to this end. In the embodiment shown in FIG. 9, a tension setter/controller 12 and a tension setter 12a are provided in the section B for this purpose. When the tension setter 12a is set to a tension suited to the first and second expander rollers 10 and 11 by turning a knob 18, the tension setter 12a determines the pressure of the oil hydraulic cylinder of a tension detection controller 12b through a converter 19 to urge a detection roller 20 against the running sheet S. A detecting section 20a detects the displacement of the detection roller 20 and issues a command which is coupled through a controller 20b to the fine speed adjustment interlock mechanism 8 for feedback control to keep the tension in the sheet S in the section B between the sets of first and second drive rollers 4a, 4b and 7, *7a* at a preset level.

FIG. 8 shows an example of the fine speed adjustment interlock mechanism 8. An extension of the shaft of the first drive roller 4a is connected to the output shaft of the fine speed adjustment interlock mechanism 8 which is a commercially available gear type differential system, and the input side thereof has a pulley 16a, around which is passed the belt 16 coupled to the second drive roller 7. The speed difference between the drive rollers 4a and 7 is varied by a control motor 21 in response to a command.

The tension in the sheet S in the section C can be adjusted such that it is made equal to the tension in the sheet S in the section B when the second drive rollers 7 and *7a* and the touch roller 6 are rotated at an equal speed and increased by 1% by increasing the speed of the touch roller 6 by 1%. Thus, the sheet S in the section C may be given a tension equal to the desired winding tension and may be directly wound in this state on the core or sheet roll being wound thereon. Generally, it need not be perfectly equal to the desired winding tension, but it need only be adjusted such that the winding force will not cause slip of the sheet being fed over the periphery of the touch roller 6 and such that the sheet will not get out of alignment or unstable. The outer periphery of the touch roller 6 is usually constituted of rubber to avoid slippage and is in an urging relation to the cores. This is desired from the standpoint of preventing the slip of the sheet.

While the construction of the invention has been described mainly in conjunction with one embodiment thereof, it is to be understood that various changes and modifications can be made in the details depending on the design conditions and skill of the designer. For example, the drive rollers 4a, 4b and 7, *7a* need not be nip rollers, but it is possible to use a roller driven in frictional contact with a sheet S. In the embodiment described above, the wound sheet rolls come into contact with the opposite sides of the intermediate touch roller, and disclosed is a system for dispensing sheets slit by the slitter to the opposite sides of the touch roller and winding the dispensed sheets around the cores. The present invention, however, should not be limited to this system. It may provide a touch roller and a fine speed adjustment interlock mechanism per core, or adopt a winding unit having a plurality of cores arranged at the upper and lower portions thereof. It may also applied to a construction such that a winding unit is movably set with a slitter disposed stationarily, that a winding unit is stationarily disposed with a touch roller set movably or that winding of a sheet is continuously effected while both a core and a touch roller are allowed to move. Also, the application of the method of supplying sheet according to the invention is not limited to the apparatus for supplying a sheet according to the invention. Further, the variation in the tension need not necessarily be completely reduced to zero. For example, the method according to the invention may be applied to the conventional sheet supply path by merely coupling the feed-out roller 4 and touch roller 6 shown in FIG. 1 to each other with a fine speed adjustment interlock mechanism. By so doing, a great improvement can be obtained. One major significance of the invention resides in that, whereas heretofore the sheet has been supplied to the winding position without varying the tension under which it is taken out from the supply roll, according to the invention it is adjusted to a level suited for the winding. In the prior art method, the winding tension is determined as an off-set between the tension in the sheet being fed and the winding force of the core. The use of the method according to the invention permits the tension in the supplied sheet to be controlled freely either by manual or automatic control. This means that the winding tension can be controlled through twofold control—i.e., the prior art winding torque control and the control of the tension in the sheet according to the invention.

What is claimed is:

1. A sheet rewinder with slitter, comprising tension adjusting means for producing a predetermined tension in a strip-like sheet taken out from a supply roll, a feed-out roller means for feeding out said strip-like sheet under the tension, a slitter for slitting the unwound strip-like sheet into a plurality of slit sheets, a plurality of cores for winding said respective slit sheets thereon and a touch roller for guiding a slit sheet to a core and provided with center drive means, said touch roller being driven by said center drive means for providing a pressure to sheet rolls which are being formed on said plurality of cores with adjustment of the winding pressure, in contact with said sheet rolls, said feed-out roller means comprising a first drive roller means and a second drive roller means located between said first drive roller means and said slitter;

an expander roller means disposed between said first drive roller means and second drive roller means;

a drive means for exerting a standard feed-out speed onto said second drive roller means;

a first fine speed adjustment interlock mechanism for finely adjusting the standard feed-out speed and transmitting the adjusted feed-out speed to said first drive roller means; and a second fine speed adjustment interlock mechanism for finely adjusting the standard feed-out speed and transmitting the adjusted feed-out speed to said touch roller;

the tension in the sheet between said supply roll and said first drive roller means being adjusted by tension adjusting means, the tension in the sheet between said first and second drive roller means being adjusted through said first fine speed adjustment interlock mechanism to suppress sheet tension variations, the tension in the sheet between said second drive roller means and said touch roller being adjusted through said second fine speed adjustment interlock mechanism to produce in the sheet an optimum tension, with which the sheet is supplied to said plurality of cores, the winding tension being adjusted by driving means for driving said plurality of cores.

2. A sheet rewinder comprising:

(a) a supply roll;

(b) a first pair of drive rollers for taking out a sheet from said supply roll;

(c) first means for adjusting the tension of the sheet between said supply roll and said first pair of drive rollers to a substantially constant value;

(d) a second pair of drive rollers downstream of said first pair of drive rollers;

(e) a plurality of cores downstream of said second pair of drive rollers, each one of said plurality of cores being subject to center drive for winding strips thereon;

(f) a touch roller for guiding the strips to said plurality of cores, said touch roller being adapted to come into pressure contact with the strips wound on said plurality of cores;

(g) second means for slitting the sheet between said second pair of drive rollers and said touch roller;

(h) third means for rotating at least one of said second pair of drive rollers;

(i) a first fine speed adjustment interlock mechanism for transmitting the rotation of said third means to at least one of said first pair of drive rollers; and (j) a second fine speed adjustment interlock mechanism for transmitting the rotation of said third means to said touch roller;

whereby the tension in the sheet between said first pair of drive rollers and said second pair of drive rollers and the tension in the sheet between said second pair of drive rollers and said touch roller is independently adjustable.

3. A sheet rewinder as recited in claim 2 wherein said first means comprises:

(a) a sheet detection roller disposed between said first and second pairs of drive rollers and (b) fourth means for feeding a signal representing the displacement of said sheet detection roller back to said first fine speed adjustment interlock mechanism.

* * * * *